US010287119B2

(12) United States Patent
Honda

(10) Patent No.: US 10,287,119 B2
(45) Date of Patent: May 14, 2019

(54) TRANSPORTING APPARATUS

(71) Applicant: SEIKO EPSON CORPORATION, Tokyo (JP)

(72) Inventor: Daisuke Honda, Fukuoka (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/944,973

(22) Filed: Apr. 4, 2018

(65) Prior Publication Data

US 2018/0334343 A1 Nov. 22, 2018

(30) Foreign Application Priority Data

May 16, 2017 (JP) ..... 2017-097180

(51) Int. Cl.
*B65H 7/12* (2006.01)
*B65H 5/06* (2006.01)

(52) U.S. Cl.
CPC ..... *B65H 7/125* (2013.01); *B65H 5/062* (2013.01); *B65H 2511/524* (2013.01); *B65H 2553/30* (2013.01)

(58) Field of Classification Search
CPC ... B65H 7/02; B65H 7/06; B65H 7/12; B65H 7/125; B65H 2553/30; B65H 2511/524
See application file for complete search history.

(56) References Cited

U.S. PATENT DOCUMENTS 6,397,671 B1 * 6/2002 Nishio ..... B65H 7/125 271/263
7,130,245 B2 * 10/2006 Okitsu ..... B65H 7/125 367/125
8,570,622 B2 * 10/2013 Pellaton ..... B65H 7/12 358/498
8,573,480 B2 * 11/2013 Ma ..... B65H 7/12 235/379
8,585,050 B2 * 11/2013 Syracuse ..... B65H 7/125 271/258.01

FOREIGN PATENT DOCUMENTS

JP 2012-188177 A 10/2012
JP 2014-047075 A 3/2014

* cited by examiner

*Primary Examiner* — Ernesto A Suarez

(57) ABSTRACT

A transporting apparatus includes a speaker and a microphone that are arranged opposite to each other with respect to a transportation path, and a controller that controls a transportation mechanism based on microphone output obtained by causing the microphone to acquire a sound emitted by the speaker. The controller uses the microphone to acquire the sound emitted by the speaker and changes, based on the microphone output, at least any of a time period during which the speaker is driven, output from the speaker, and the microphone output.

6 Claims, 6 Drawing Sheets

TRANSPORTING APPARATUS

BACKGROUND

1. Technical Field

The present invention relates to a transporting apparatus.

2. Related Art

A double-feeding detection apparatus that detects transportation (double feeding) in a state in which media overlap each other is known (refer to JP-A-2014-47075 and JP-A-2012-188177). The double-feeding detection apparatus includes a transmitter configured to transmit an ultrasonic wave toward a recording medium being transported and a receiver arranged on the opposite side of the transmitter with respect to a transport path and configured to receive an ultrasonic wave that has passed through the recording medium. The double-feeding detection apparatus determines, based on the level of a signal received by the receiver, whether or not recording media are transported while overlapping each other.

The double-feeding detection has been requested to be further improved.

SUMMARY

An advantage of some aspects of the invention is that it solves at least a part of the aforementioned problems, and the invention can be achieved as the following aspects.

According to an aspect of the invention, a transporting apparatus includes a transportation mechanism that transports a medium; a speaker and a microphone that are arranged opposite to each other with respect to a transportation path for the medium; and a controller that controls the transportation mechanism based on microphone output in a first operation of causing the microphone to acquire a sound emitted by the speaker and having passed through the medium being transported by the transportation mechanism. If the duration of the microphone output is shorter than a threshold related to time in a second operation of causing the microphone to acquire a sound emitted by the speaker before the first operation, the controller configures first settings to increase a time period during which the speaker is driven in the first operation. If the duration of the microphone output is equal to or longer than the threshold in the second operation, the controller configures second settings to increase at least any of output from the speaker and the degree of amplification to be executed on the microphone output in the first operation.

According to this configuration, in the second operation executed before the first operation, settings to be configured for the first operation in the case where the duration of the microphone output is relatively short can be different from settings to be configured for the first operation in the case where the duration of the microphone output is relatively long. Specifically, settings appropriate for the first operation can be configured based on the cause of a malfunction in the second operation before the first operation, and as a result, the transportation mechanism can be appropriately controlled based on the microphone output in the first operation (for example, based on a double-feeding detection process executed based on the microphone output).

In this case, if there is a time period during which the microphone output is equal to or larger than a threshold related to the microphone output, and the duration of the microphone output that is equal to or longer than the threshold related to the microphone output is shorter than the threshold related to time in the second operation, the controller may configure the first settings, and if there is not a time period during which the microphone output is equal to or larger than the threshold related to the microphone output, and the duration of the microphone output is equal to or longer than the threshold related to time, the controller may configure the second settings.

According to this configuration, settings for the first operation can vary in accordance with a branch based on a detailed state of the microphone output in the second operation before the first operation.

In this case, if the maximum value of the microphone output obtained when the frequency of a sound to be emitted by the speaker is changed to multiple frequencies and the speaker is driven is equal to or larger than a threshold related to the maximum value, the controller may configure third settings that do not correspond to the first settings and the second settings in the first operation.

According to this configuration, if the maximum value of the microphone output obtained when the frequency is changed and the speaker is driven is equal to or larger than the predetermined threshold in the second operation or if the second operation is normal, the controller configures the third settings that do not correspond to the first settings and the second settings in the first operation.

In this case, the controller may execute the control based on an envelope waveform of the microphone output.

According to this configuration, the transportation mechanism can be appropriately controlled based on the envelope waveform of the microphone output (for example, based on double-feeding detection executed based on the envelope waveform).

In this case, the controller may change the frequency of a sound to be emitted by the speaker to multiple frequencies and drive the speaker in the first operation.

According to this configuration, even if the microphone output is not stable due to an effect of the temperature of a peripheral environment in the first operation, it is possible to remove the effect of the temperature and obtain appropriate microphone output by changing the frequency to the multiple frequencies and driving the speaker.

In this case, the controller may control the frequency so that a range in which the frequency is changed in the first operation executed at predetermined time after the initial first operation is narrower than a range in which the frequency is changed in the initial first operation executed after the second operation.

According to this configuration, it is possible to narrow a range in which the frequency is changed down to a necessary range and reduce a processing amount required for the first operation in a step-by-step manner by repeating the first operation.

The technical idea of the invention is achieved in various aspects other than a category of transporting apparatuses. For example, a method including a process to be executed by the transporting apparatus, a program for causing hardware (computer) to execute the method, and a computer-readable storage medium storing the program are regarded as the invention.

BRIEF DESCRIPTION OF THE DRAWINGS

The invention will be described with reference to the accompanying drawings, wherein like numbers reference like elements.

DESCRIPTION OF EXEMPLARY EMBODIMENT

Hereinafter, an embodiment of the invention is described with reference to the accompanying drawings. The accompanying drawings are only examples to be used to describe the embodiment.

1. Overview of Apparatus

Figure 1:
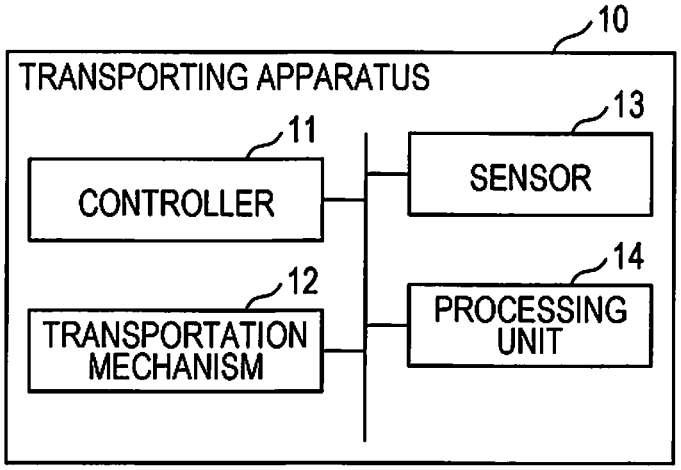
FIG. 1 is a diagram showing a configuration of a transporting apparatus in a simplified manner.

FIG. 1 shows a configuration of a transporting apparatus 10 according to the embodiment in a simplified manner.

Figure 2:
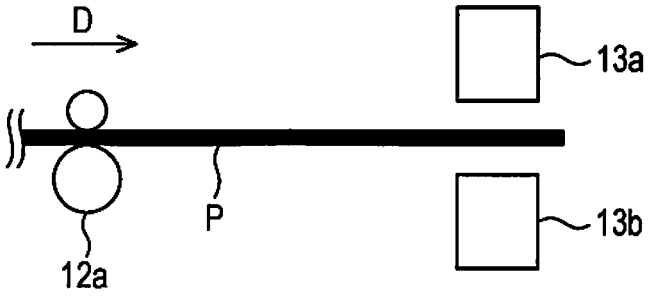
FIG. 2 is a diagram showing a portion within a housing of the transporting apparatus in a simplified manner.

FIG. 2 shows a portion within a housing of the transporting apparatus 10 in a simplified manner.

The transporting apparatus 10 has a configuration (transportation mechanism) for transporting a sheet medium. FIG. 2 shows a state in which a medium P is transported in a predetermined transportation direction D. The sheet medium is representative paper, but may be a medium of a material other than paper.

The transporting apparatus 10 includes a controller 11, a transportation mechanism 12, a sensor 13, a processing unit 14, and the like, for example. The controller 11 is composed of one or multiple ICs having a CPU, a ROM, a RAM, and the like, another memory, an analog circuit, and the like, for example. The controller 11 controls an entire operation of the transporting apparatus 10 by causing an installed program and hardware to collaborate with each other.

The transportation mechanism 12 transports the medium P under control by the controller 11. The transportation mechanism 12 has a known configuration including a roller 12*a* for transporting the medium P, a motor for generating power to rotate the roller 12*a*, a gear train for transferring the power generated by the motor to the roller 12*a*, and the like, for example. The transportation mechanism 12 may include an auto document feeder (ADF) for separating, one by one, multiple media P stacked on a tray (not shown) and transporting the media P toward a downstream side in the transportation direction D.

The sensor 13 includes a speaker (transmitter) 13*a* and a microphone (receiver) 13*b* that are arranged opposite to each other with respect to a transportation path for media P. The speaker 13*a* emits a sound (sound wave), while the microphone 13*b* receives the sound emitted by the speaker 13*a*. It is assumed that the sensor 13 is an ultrasonic sensor that transmits and receives an ultrasonic wave.

The processing unit 14 is arranged on the downstream side with respect to the sensor 13 in the transportation direction D and executes a predetermined process on a transported medium P under control by the controller 11. The predetermined process may be a reading process or a printing process, for example. Specifically, the processing unit 14 may be a reading unit for optically reading a manuscript (medium P) and generating electronic data as the reading result or may be a printing unit for executing printing on the medium P using ink or toner. If the processing unit 14 is the reading unit, the transporting apparatus 10 may be a scanner. If the processing unit 14 is the printing unit, the transporting apparatus 10 may be a printer. The transporting apparatus 10 may be a multifunction machine including multiple functions such as a scanner and a printer. Although not shown, the transporting apparatus 10 has a known configuration of a multifunction machine including a scanner and a printer and includes a display unit configured to display visual information, an operating unit that is configured to receive an operation from a user and is a touch panel, a physical button, or the like, a communication interface configured to execute communication with an external in accordance with a predetermined communication protocol, and the like.

The controller 11 controls the transportation mechanism 12 based on microphone output in a first operation of causing the microphone 13*b* to acquire a sound emitted by the speaker 13*a* and having passed through a medium P being transported by the transportation mechanism 12. The degree of the attenuation of a sound wave that has passed through a single medium P being transported (single feeding) and has been received by the microphone 13*b* is different from the degree of the attenuation of a sound wave that has passed through media P being transported while overlapping each other (double feeding) and has been received by the microphone 13*b*. Thus, the controller 11 can detect single feeding or double feeding based on the microphone output or can execute double feeding detection based on the microphone output. Thus, it can be said that the first operation is a part of a double feeding detection process. If the controller 11 detects the double feeding based on the microphone output, the controller 11 stops the transportation mechanism 12 to stop media P from being further transported while overlapping each other, for example. Since the controller 11 can execute the double feeding detection, the transporting apparatus 10 may be a double feeding detection apparatus.

2. Description of Preadjustment Process

Next, a preadjustment process to be executed by the transporting apparatus 10 is described. The preadjustment process is executed before the transporting apparatus 10 is shipped to market. If the first operation is a process to be executed in the case where the user uses the transporting apparatus 10 after the shipment, the preadjustment process corresponds to a specific example of a second operation to be executed before the first operation.

Figure 3:
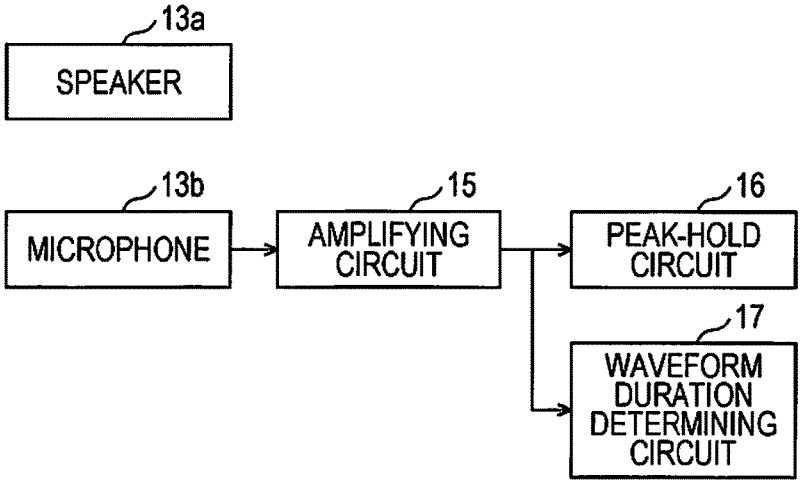
FIG. 3 is a block diagram showing a partial configuration of the transporting apparatus.

FIG. 3 is a block diagram showing a partial configuration of the transporting apparatus 10. FIG. 3 shows an example in which the transporting apparatus 10 includes the aforementioned speaker 13*a*, the aforementioned microphone 13*b*, an amplifying circuit 15, a peak-hold circuit 16, and a waveform duration determining circuit 17. The circuits 15, 16, and 17 may be a portion of the controller 11.

The amplifying circuit 15 amplifies a waveform (analog waveform) received by the microphone 13*b* from the speaker 13*a* and outputs the amplified waveform. The peak-hold circuit 16 executes analog-to-digital (AD) conversion on the waveform output from the amplifying circuit 15 and holds and outputs a peak value of the waveform. The output from the peak-hold circuit 16 is obtained as an envelope waveform. The waveform duration determining circuit 17 analyzes the waveform output from the amplifying circuit 15 and determines the duration of the waveform. Details of the determination by the waveform duration determining circuit 17 are described later (refer to steps S120 and S130 shown in FIG. 4).

Figure 4:
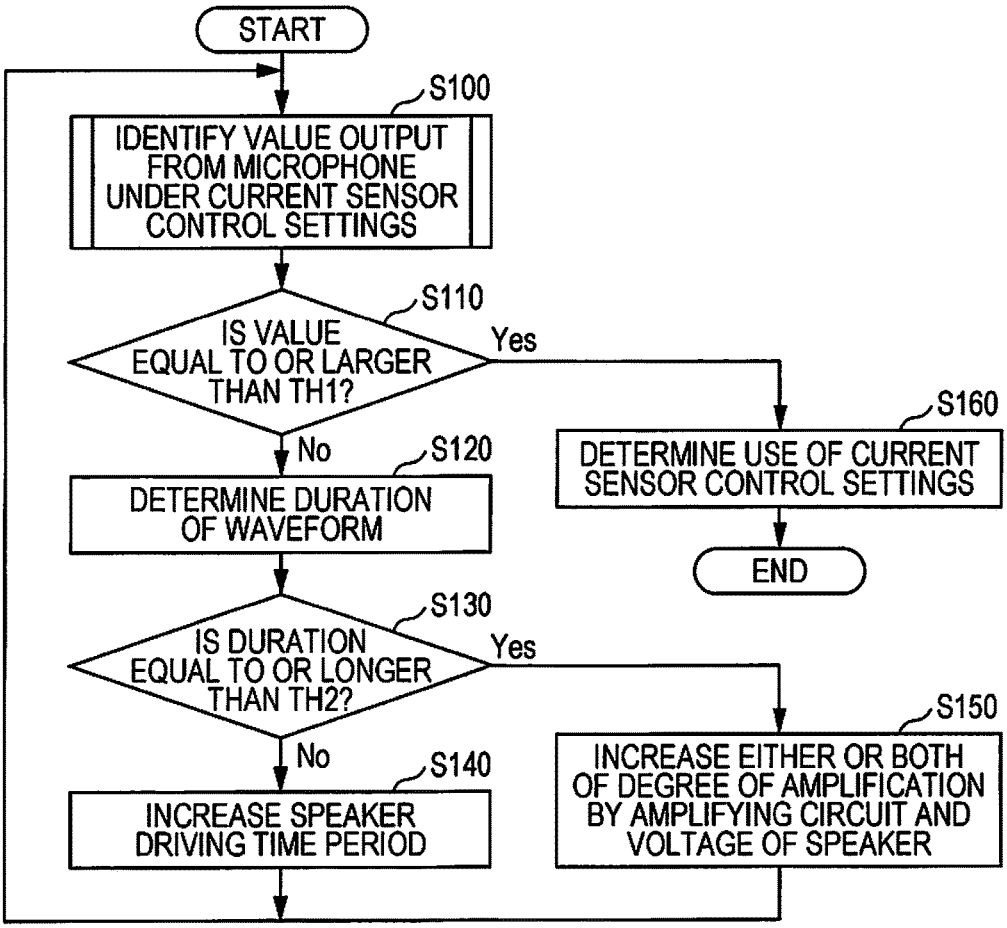
FIG. 4 is a flowchart of a preadjustment process.

FIG. 4 is a flowchart of the preadjustment process. In the preadjustment process, the transporting apparatus 10 uses the transportation mechanism 12 to execute single feeding to transport a single medium P and uses the microphone 13*b* to acquire a sound emitted by the speaker 13*a*. Specifically, the preadjustment process is a process of configuring necessary settings to intentionally execute the single feeding and reliably detect the single feeding (so as not to detect double feeding).

First, the controller 11 identifies a value output from the microphone 13*b* under current sensor control settings (in step S100). The sensor control settings indicate the setting of the length of a time period (speaker driving time period) from the time when the speaker 13*a* is driven with a single driving frequency to the time when the speaker 13*a* emits a sound wave, the setting of the voltage of a driving signal (pulse) to be given to the speaker 13*a*, and the setting of the degree (amplification rate) of the amplification by the amplifying circuit 15. In the initial step S100 of the preadjustment process, the controller 11 uses initial settings defined in advance as the current sensor control settings. In step S100, the controller 11 executes a sweeping process of acquiring a value output from the microphone 13*b* while changing the frequency of a sound to be emitted by the speaker 13*a* to multiple frequencies and driving the speaker 13*a*.

Figure 5:
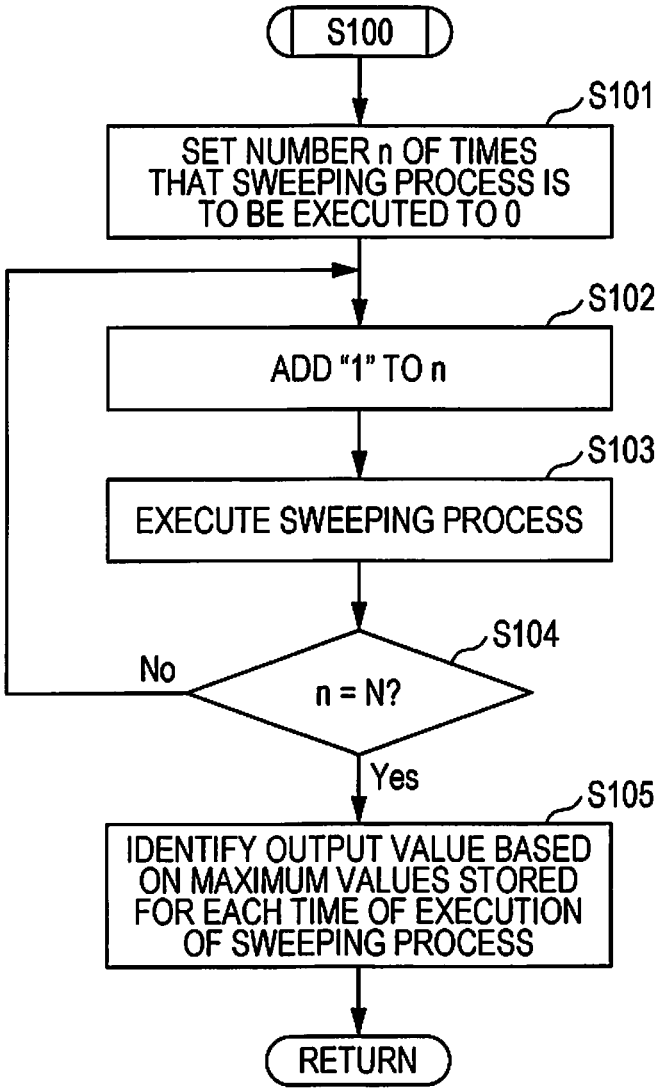
FIG. 5 is a flowchart showing details of step S100 of the preadjustment process.

FIG. 5 is a flowchart showing details of step S100.

First, the controller 11 sets a number n of times that the sweeping process is to be executed to an initial value (n=0) (in step S101). Next, the controller 11 adds "1" to the number n of times that the sweeping process is to be executed (in step S102). After step S102, the controller 11 executes the sweeping process (in step S103).

A specific example of the sweeping process is described below. The controller 11 changes the frequency (driving frequency) of the driving signal to be given to the speaker 13*a* in a step-by-step manner so that the frequency is in a frequency range defined in advance. For example, the controller 11 changes the driving frequency in units of p kHz (for example, 5 kHz) for each speaker driving time period so that the driving frequency is in a range of frequencies from a predetermined lower limit frequency (of, for example, 280 kHz) to a predetermined upper limit frequency (of, for example, 320 kHz). If the driving frequency of the speaker 13*a* is changed in units of p kHz for each speaker time period, and the speaker 13*a* is driven with a number m of driving frequencies (for example, 9 driving frequencies of 280 kHz, 285 kHz, 290 kHz, 295 kHz, 300 kHz, 305 kHz, 310 kHz, 315 kHz, and 320 kHz), the controller 11 acquires an envelope waveform from the peak-hold circuit 16 a number m of times in the sweeping process executed once.

Figure 6:
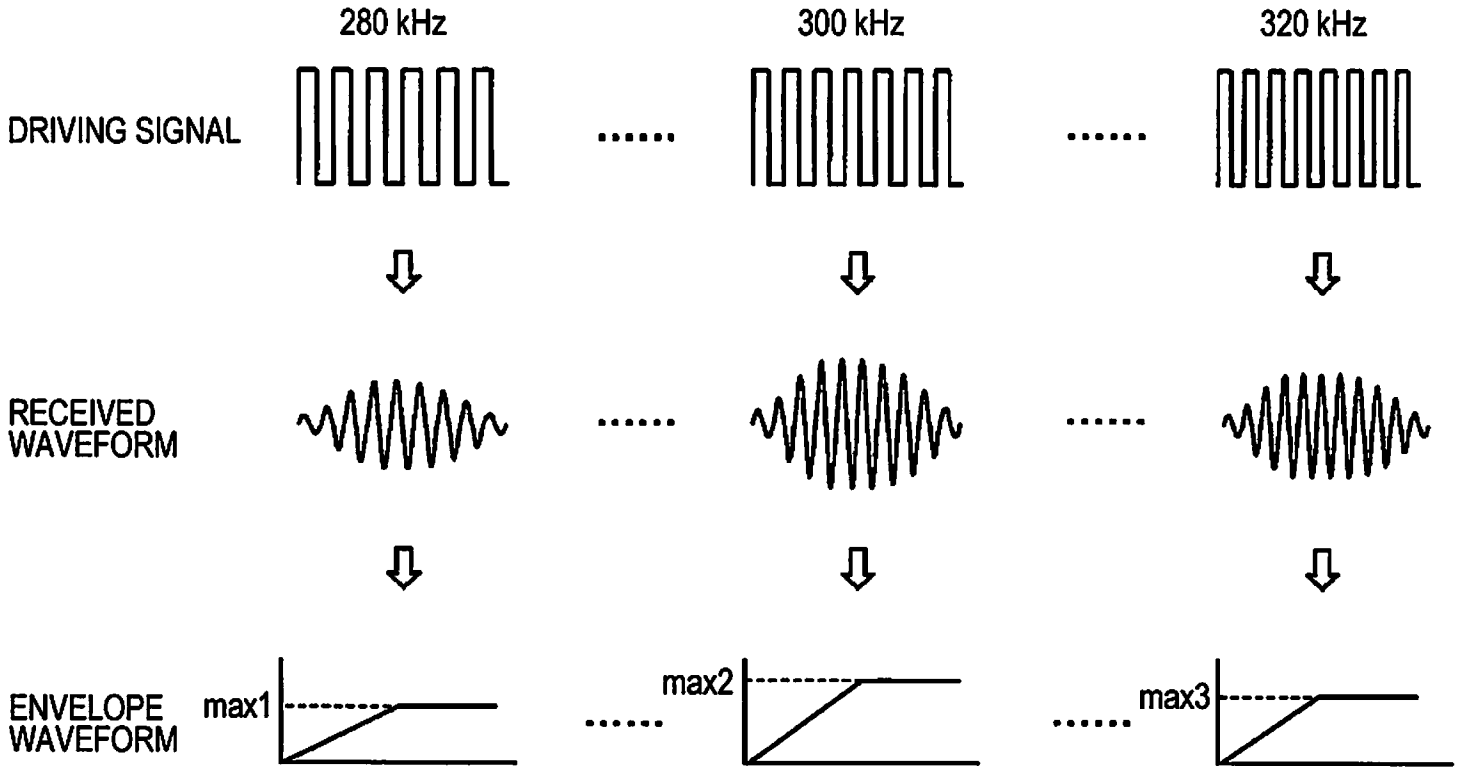
FIG. 6 is a diagram showing waveforms for different driving frequencies in a sweeping process.

FIG. 6 is a diagram showing waveforms (or waveforms (continuous waveforms) output from the amplifying circuit 15) received by the microphone 13*b* for different driving frequencies (driving signal of the speaker 13*a*) in the sweeping process executed once, and envelope waveforms output from the peak-hold circuit 16. FIG. 6 shows the received waveforms corresponding to three driving frequencies (280 kHz, 300 kHz, and 320 kHz) among the number m of driving frequencies and the envelope waveforms corresponding to the three driving frequencies (280 kHz, 300 kHz, and 320 kHz) among the number m of driving frequencies as an example. As is apparent from FIG. 6, peak values of the waveforms obtained on the reception side are different for the driving frequencies. This is caused by an effect of the temperature of an environment around the sensor 13 (ultrasonic sensor). A frequency (resonant frequency) to which the ultrasonic sensor is the most sensitive may vary depending on the temperature. Thus, when the sweep process is executed in the aforementioned manner, the largest peak value that corresponds to a driving frequency close to the frequency to which the ultrasonic sensor is the most sensitive for the temperature at that time is accordingly obtained on the reception side. Thus, the controller 11 stores the maximum value (for example, the maximum value max2 among peak values max1, max2, and max3) (refer to FIG. 6) among peak values of envelope waveforms acquired from the peak-hold circuit 16 the number m of times in the sweeping process executed once, as the maximum value among values output from the microphone 13*b* in the sweeping process executed once.

Next, the controller 11 determines whether or not the number n of times that the sweeping process has been executed has reached a defined number N (N is an integer of 2 or more) of times. If n=N ("Yes" in step S104), the controller 11 causes a process shown in FIG. 5 to proceed to step S105. If n<N ("No" in step S104), the controller 11 causes the process to return to step S102. Specifically, the controller 11 repeats the sweeping process of step S103 the number N of times, thereby storing the maximum value among values output from the microphone 13*b* for each of times of the execution of the sweeping process.

In step S105, the controller 11 identifies a value output from the microphone 13*b* based on a number N of maximum values stored for the number N of times of the execution of the sweeping process. For example, the controller 11 identifies the average of the number N of maximum values as the value output from the microphone 13*b*. Alternatively, the controller 11 may identify the maximum value among the number N of maximum values as the value output from the microphone 13*b*. Then, the controller 11 terminates step S105 and causes the process to proceed to step S110 (FIG. 4).

In step S110, the controller 11 determines whether or not the value output from the microphone 13*b* and identified in step S100 (step S105 shown in FIG. 5) in the aforementioned manner is equal to or larger than a predetermined threshold TH1 related to the maximum value of the microphone output. The threshold TH1 is used to determine single feeding or double feeding or execute the double feeding detection. If the value output from the microphone 13*b* and identified is equal to or larger than the threshold TH1 ("Yes" in step S110), the controller 11 determines that the current sensor control settings are used in the double feeding detection process to be executed in the future (in step S160) and terminates the preadjustment process.

Specifically, if the output value indicating a signal received by the microphone 13*b* after the emission of a sound wave by the speaker 13*a* in a state in which a single medium P is transported is equal to or larger than the threshold TH1, it can be said that the double feeding detection process has been appropriately executed, and the preadjustment process is terminated without a change in the current sensor control settings. Thus, if the controller 11 determines that the answer to step S110 initially executed in the preadjustment process is "Yes", the controller 11 determines that the initial sensor control settings are used in the double feeding detection process to be executed in the future (in step S160), and the controller 11 terminates the preadjustment process. The initial sensor control settings correspond to "third settings that do not correspond to first settings and second settings" in claims.

On the other hand, if the value output from the microphone 13*b* and identified in step S100 is smaller than the threshold TH1 ("No" in step S110), the process proceeds to step S120.

In step S120, the controller 11 (waveform duration determining circuit 17) analyzes a waveform (microphone output) output from the amplifying circuit 15 and determines the duration of the output waveform. In this case, the waveform duration determining circuit 17 needs to identify the single continuous waveform to be determined. The single continuous waveform is received by the microphone 13*b* and output from the amplifying circuit 15*a* when the speaker 13*a* is driven with a single driving frequency during a speaker driving time period and transmits a sound wave, as stated in the description of the sweeping process. The waveform duration determining circuit 17 identifies, as a waveform to be determined, the single continuous waveform including a waveform from which the maximum amplitude is obtained in the sweeping process executed multiple times in step S100 executed under the current sensor control settings, for example. Then, the waveform duration determining circuit 17 compares the duration of the identified single continuous waveform with a predetermined threshold TH2 related to time.

Figure 7:
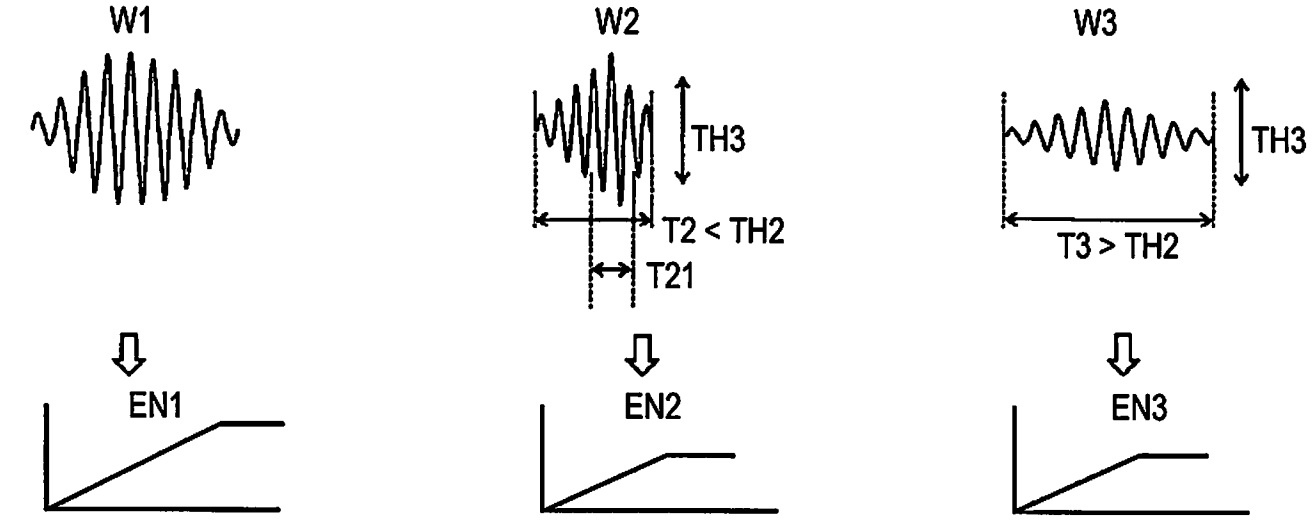
FIG. 7 is a diagram comparing waveforms whose duration is different and whose amplitudes are different with each other.

FIG. 7 exemplifies waveforms (W1, W2, and W3) obtained in the preadjustment process and output from the amplifying circuit 15 and envelope waveforms (EN1, EN2, and EN3) corresponding to the output waveforms and output from the peak-hold circuit 16. It is expected that, in step S120, the waveform duration determining circuit 17 identifies, as the waveform to be determined, a single continuous waveform such as the output waveform W2 or W3 exemplified in FIG. 7. The output waveform W1 exemplified in FIG. 7 serves as the origin of the value (output value identified in step S100) output from the microphone 13*b* and determined to be equal to or larger than the threshold TH1 in step S110. This example assumes that the output waveform W1 is not to be determined in step S120. Specifically, it may be considered that a peak value of the envelope waveform EN1 is equal to or larger than the aforementioned threshold TH1 and that peak values of the envelope waveforms EN2 and EN3 are smaller than the threshold TH1.

When the output waveform W3 is compared with the output waveform W1, the duration T3 of the output waveform W3 is nearly equal to the duration of the output waveform W1, but the amplitude of the output waveform W3 is entirely smaller than the amplitude of the output waveform W1. If the output waveform W3 is input to the peak-hold circuit 16, the envelope waveform EN3, of which the peak value is smaller than that of the envelope waveform EN1 output when the output waveform W1 is input to the peak-hold circuit 16, is output.

When the output waveform W2 is compared with the output waveform W1, the maximum amplitude of the output waveform W2 is nearly equal to the maximum amplitude of the output waveform W1, but the duration T2 of the output waveform W2 is shorter than the duration of the output waveform W1. If the driving frequency of the speaker 13*a* is different from the frequency (resonant frequency) to which the sensor 13 (ultrasonic sensor) is the most sensitive, the amplitude of the waveform received by the microphone 13*b* is distorted and may be reduced to 0 at relatively early time (time earlier than the time when the speaker 13*a* is driven). The output waveform W2 indicates that the amplitude of the output waveform W2 is reduced to 0 at early time due to the distortion of the amplitude of the received waveform. If the output waveform W2 is input to the peak-hold circuit 16, the envelope waveform EN2, of which the peak value is smaller than that of the envelope waveform EN1 output when the waveform W1 whose amplitude is nearly equal to that of the waveform W2 and whose duration is long is input, may be output, depending on the processing power (input tracking performance) of the peal-hold circuit 16.

Specifically, if a waveform received by the microphone 13*b* has a large amplitude (amplitude normally expected to be obtained on the reception side in the single feeding state) and the duration of the received waveform is short, or if the amplitude of a waveform received by the microphone 13*b* is small, the peak value of an envelope waveform output from the peak-hold circuit 16 is small. In other words, if the controller 11 determines that the answer to step S110 is "No", and the envelope waveform is evaluated, it is difficult to determine the reason for a small peak value of the envelope waveform (or determine whether the reason is that the waveform received by the microphone 13*b* has a large amplitude but the duration of the waveform is short or is that the amplitude of the received waveform is small). Measures to be taken to appropriately achieve the double feeding detection process vary depending on the aforementioned reason.

For example, it is assumed that, if a waveform received by the microphone 13*b* in the single feeding state has a large amplitude and the duration of the received waveform is short, an amplification rate of the amplifying circuit 15 is set to be increased as measures. In this case, in the double feeding detection process after that, the amplitude of the waveform received by the microphone 13*b* after the amplification by the amplifying circuit 15 in the single feeding state does not largely change due to amplitude saturation. The amplitude of the waveform received by the microphone 13*b* after the amplification by the amplifying circuit 15 in the double feeding state is significantly large. As a result, this increases the probability of reducing the accuracy of determining single feeding or double feeding based on an envelope waveform output from the peak-hold circuit 16. On the other hand, it is assumed that, if the amplitude of the waveform received by the microphone 13*b* in the single feeding state is small, the amplification rate of the amplifying circuit 15 is set to be increased as measures. In this case, in the double feeding detection process after the setting, the amplitude of the waveform received by the microphone 13*b* after the amplification by the amplifying circuit 15 in the single feeding state is significantly large, and as a result, the accuracy of determining single feeding or double feeding based on an envelope waveform output from the peak-hold circuit 16 is not reduced.

If the waveform duration determining circuit 17 determines that the duration of the single continuous waveform identified in step S120 is shorter than the threshold TH2 as a result of the comparison of the duration of the single continuous waveform identified in step S120 with the threshold TH2, the waveform duration determining circuit 17 selects "No" at a branch of step S130 and causes the process to proceed to step S140. For example, if the waveform identified as the waveform to be determined in step S120 is the output waveform W2, the duration T2 of the waveform W2<the threshold TH2, and the waveform duration determining circuit 17 causes the process to proceed to step S140 from the branch of step S130.

On the other hand, if the waveform duration determining circuit 17 determines that the duration of the single continuous waveform identified in step S120 is equal to or longer than the threshold TH2 as a result of the comparison of the duration of the single continuous waveform identified in step S120 with the threshold TH2, the waveform duration determining circuit 17 selects "Yes" at the branch of step S130 and causes the process to proceed to step S150. For example, if the waveform identified as the waveform to be determined in step S120 is the output waveform W3, the duration T3 of the waveform W3>the threshold TH2, and the waveform duration determining circuit 17 causes the process to proceed to step S150 from the branch of step S130.

In step S140, the controller 11 changes the current sensor control settings. In this case, the controller 11 increases the speaker driving time period among the current sensor control settings based on the difference between the threshold TH1 and the value output from the microphone 13*b* and identified in the latest step S100. The "current sensor control settings" after step S140 correspond to the "first settings" in claims. After step S140, the controller 11 repeats the processes of S100 and later. By executing step S140, the speaker driving time period is increased. Thus, the duration of the single continuous waveform received by the microphone 13*b* is increased in step S100 after step S140, and the probability that an output value identified in step S100 in the aforementioned manner is determined to be equal to or larger than the threshold TH1 in step S110 increases.

In step S150, the controller 11 changes the current sensor control settings. In this case, the controller 11 increases the voltage of the driving signal to be given to the speaker 13*a* or the degree (amplification rate) of the amplification by the amplifying circuit 15 among the current sensor control settings based on the difference between the threshold TH1 and the value output from the microphone 13*b* and identified in the latest step S100. Alternatively, the controller 11 increases the voltage and the degree of the amplification. The "current sensor control settings" after step S150 correspond to the "second settings" in claims. After step S150, the controller 11 repeats the processes of step S100 and later. The amplitude of the waveform output from the amplifying circuit 15 is increased in step S100 after step S150, and the probability that an output value identified in step S100 in the aforementioned manner is determined to be equal to or larger than the threshold TH1 in step S110 increases.

In the aforementioned preadjustment process, the sensor control settings (the speaker duration time period, the voltage of the driving signal to be given to the speaker 13*a*, and the degree of the amplification by the amplifying circuit 15) are optimized for the execution of the double feeding detection process.

In step S120, the waveform duration determining circuit 17 may determine, in more detail, the microphone output (single continuous waveform) to be determined. Specifically, if there is a time period during which the amplitude of the single continuous waveform to be determined is equal to or larger than a threshold (threshold TH3 related to the amplitude of a waveform) related to the microphone output, and the duration of the waveform whose amplitude is equal to or longer than the threshold TH3 is shorter than the threshold TH2, the waveform duration determining circuit 17 may select "No" at the branch of step S130 and cause the process to proceed to step S140. The threshold TH3 is a value indicating an amplitude normally expected to be obtained on the reception side (output of the amplifying circuit 15) in the single feeding state. For example, if the waveform identified to be determined in step S120 is the output waveform W2 (FIG. 7), there is a time period during which the amplitude is equal to or larger than the threshold TH3, the duration T2 of the waveform W2 whose amplitude is equal to or longer than the threshold TH3 is shorter than the threshold TH2, and the waveform duration determining circuit 17 causes the process to proceed to step S140 from the branch of step S130.

It can be basically said that, in step S120, there is no case where there is a time period during which the amplitude of the single continuous waveform to be determined is equal to or larger than the threshold TH3 and where the duration of the single continuous waveform whose amplitude is equal to or longer than the threshold TH3 is equal to or longer than the threshold TH2 (for example, the single continuous waveform is a waveform like the output waveform W1 shown in FIG. 7). Thus, if there is not a time period during which the amplitude of the single continuous waveform identified to be determined in step S120 is equal to or larger than the threshold TH3, and the duration of the waveform is equal to or longer than the threshold TH2, the process proceeds to step S150 from the branch of step S130. For example, if the waveform identified to be determined in step S120 is the output waveform W3 (FIG. 7), there is not a time period during which the amplitude is equal to or larger than the threshold TH3, the duration T3 of the waveform W3 is equal to or longer than the threshold TH2, the waveform duration determining circuit 17 causes the process to proceed to step S150 from the branch of step S130.

There may not be a time period during which the amplitude of the single continuous waveform identified to be determined in step S120 is equal to or larger than the threshold TH3, and the duration of the waveform may be shorter than the threshold TH2. In this case, it is said that step S140 and step S150 are executed at least once until the controller 11 determines that the answer to step S110 is "Yes". Thus, if there is not a time period during which the amplitude of the single continuous waveform identified to be determined in step S120 is equal to or larger than the threshold TH3, and the duration of the waveform is shorter than the threshold TH2, the waveform duration determining circuit 17 may cause the process to proceed to both step S140 and step S150 in an exceptional case.

3. Description of Double Feeding Detection Process

The transporting apparatus 10 subjected to the preadjustment process is shipped to market and used by the user. The controller 11 executes the double feeding detection process under the sensor control settings upon causing the transportation mechanism 12 to transport a medium P.

Figure 8:
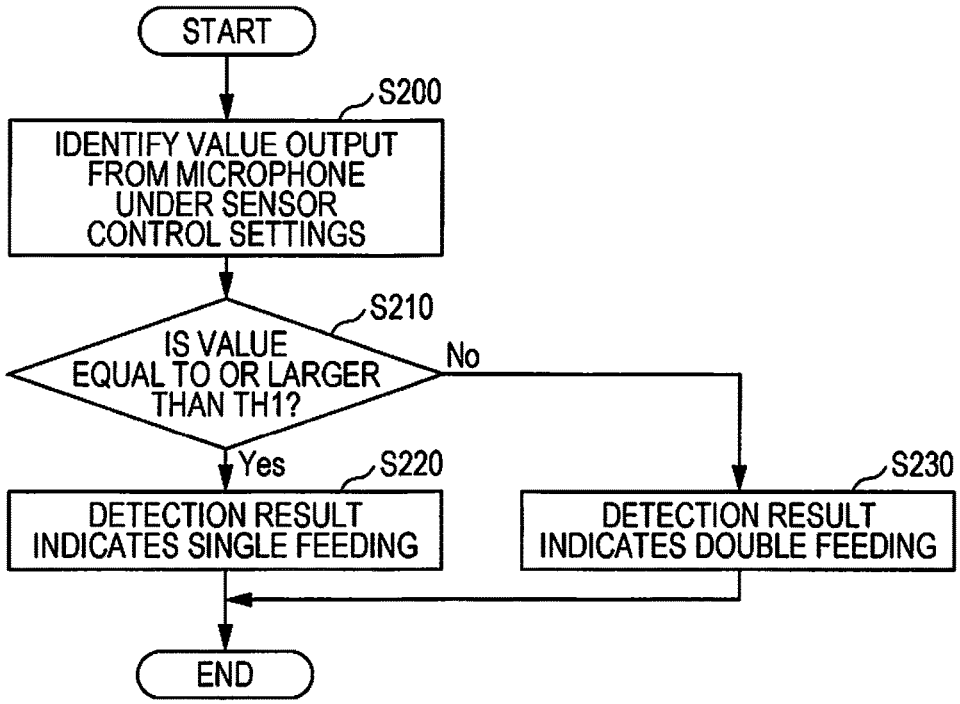
FIG. 8 is a flowchart of a double-feeding detection process.

FIG. 8 is a flowchart of the double feeding detection process. Steps S200 and S210 of the double feeding detection process are the same processes as steps S100 and S110 of the preadjustment process (FIG. 4). Thus, FIG. 5 shows the details of step S100 and details of step S200. Sensor control settings to be used in step S200 are the sensor control settings determined to be used in step S160 of the preadjustment process. The preadjustment process is executed while the single feeding is intentionally executed. In a state in which the user normally uses the transporting apparatus 10 after the preadjustment process, media P may be transported while overlapping each other due to a malfunction of the ADF, the fact that the media P are hardly separated from each other due to a static effect, or the like, for example.

In step S210, the controller 11 determines whether or not the value output from the microphone 13*b* and identified in step S200 is equal to or larger than the aforementioned threshold TH1. If the value output from the microphone 13*b* and identified in step S200 is equal to or larger than the threshold TH1 ("Yes" in step S210), the controller 11 causes the process to proceed to step S220, obtains the detection result indicating single feeding or indicating that the medium P is normally transported, and the controller 11 terminates the double feeding detection process. On the other hand, if the value output from the microphone 13*b* and identified in step S200 is smaller than the threshold TH1 ("No" in step S210), the controller 11 causes the process to proceed to step S230, obtains the detection result indicating double feeding, and terminates the double feeding detection process. If the controller 11 obtains the detection result indicating the double feeding and terminates the double feeding detection process, the controller 11 executes control to stop the transportation mechanism 12 and provides an alert notifying the double feeding to the user by displaying a message or the like or outputting audio, for example.

As is understood from the above description, the controller 11 changes the frequency of a sound to be emitted by the speaker 13*a* to multiple frequencies and drives the speaker 13*a* in step S200 executed in the double feeding detection process (FIG. 8) or executes the sweeping process (step S103 shown in FIG. 5). In this case, the controller 11 may execute a sweeping range change process of changing a sweeping range in the first operation (double feeding detection process) executed at predetermined time after the initial first operation (double feeding detection process) so that the changed sweeping range is narrower than a range (sweeping range) in which the frequency is changed in the initial first operation (double feeding detection process).

Figure 9:
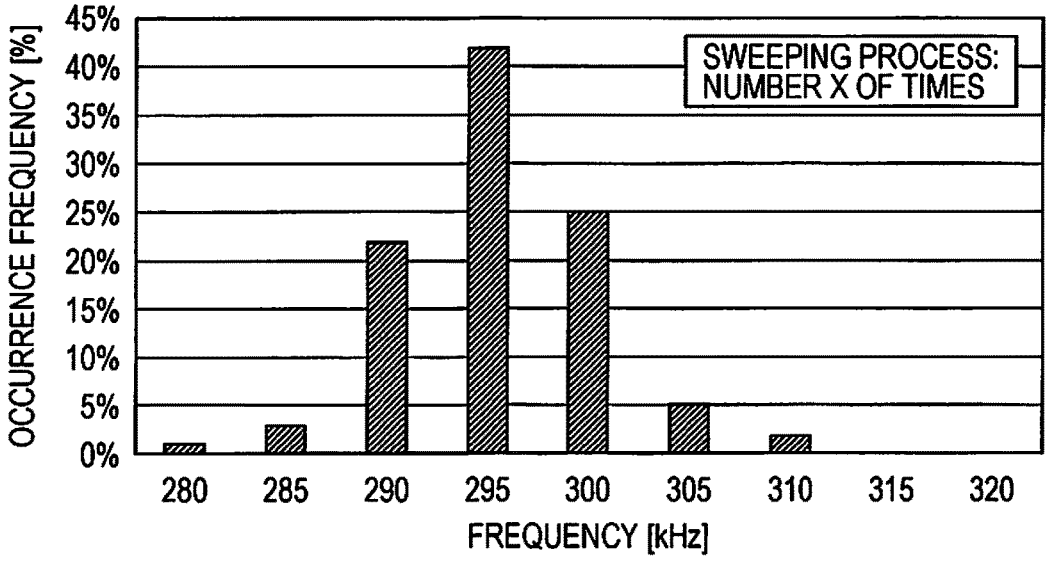
FIG. 9 is a diagram showing the occurrence frequency of the maximum value for each driving frequency in the sweeping process.

FIG. 9 shows a graph indicating the occurrence frequency of the maximum value for each driving frequency of the speaker 13*a* in the sweeping process. The abscissa shown in FIG. 9 indicates the aforementioned number m of levels (9 levels) of the driving frequency, to be changed in the sweeping process, of the speaker 13*a*, and the ordinate shown in FIG. 9 indicates the occurrence frequency of the maximum value. The maximum values are among peak values of envelope waveforms acquired from the peak-hold circuit 16 the number m of times in the sweeping process executed once. For example, if the envelope waveforms shown in FIG. 6 are obtained in the sweeping process executed once, the driving frequency of 300 kHz when the peak value of the envelope waveform is maximal (max2) among the envelope waveforms causes the maximum value in the sweeping process executed once. FIG. 9 shows the occurrence frequencies of the maximum values for each driving frequency in the sweeping process executed a number X of times after the initial double feeding detection process executed after the preadjustment process. X is a predetermined numerical value larger than N used in step S104 shown in FIG. 5. Thus, a value obtained by dividing X by N is the number of times that the double feeding detection process is executed until the graph shown in FIG. 9 is obtained after the preadjustment process.

Every time the sweeping process is executed after the preadjustment process, the controller 11 stores a driving frequency corresponding to an envelope waveform from which the maximum value among peak values is obtained. Then, when the number of times that the sweeping process has been executed has reached the number X of times (or when the number of times that the double feeding detection process has been executed has reached the value of X/N), the controller 11 executes the sweeping range change process. In the sweeping range change process, the controller 11 resets the sweeping range while excluding a driving frequency that causes the occurrence frequency of the maximum value to be 0%. In the example shown in FIG. 9, since the driving frequencies 315 kHz and 320 kHz cause the occurrence frequencies of the maximum values to be 0%, the controller 11 resets the sweeping range to a range of 280 kHz to 310 kHz while excluding the frequencies of 315 kHz and 320 kHz from the previous sweeping range (of 280 kHz to 320 kHz). There is no problem if a driving frequency that does not cause the maximum value affecting the identification (step S200) of the value output from the microphone 13*b* is excluded from the sweeping range.

In the double feeding detection process (FIG. 8) after the sweeping range is reset in the sweeping range change process, the controller 11 executes the sweeping process while changing the driving frequency of the speaker 13*a* in units of p kHz so that the driving frequency is in the reset sweeping range. By narrowing the sweeping range down to a necessary range based on the state of the sweeping process, a processing amount required for the double feeding detection process can be reduced. In the sweeping range change process, the controller 11 may not exclude a driving frequency causing the occurrence frequency of the maximum value to be 0% and may exclude, from the sweeping range, a driving frequency causing the occurrence frequency of the maximum value to be lower than a predetermined threshold (for example, a frequency of 5%).

4. General Overview

According to the embodiment, the transporting apparatus 10 includes the transportation mechanism 12 that transports a medium P, the speaker 13 and the microphone 13*b* that are arranged opposite to each other with respect to the transportation path for the medium P, and the controller 11 that controls the transportation mechanism 12 based on the microphone output in the first operation of causing the microphone 13*b* to acquire a sound emitted by the speaker 13*a* and having passed through the medium P being transported by the transportation mechanism 12. In the second operation (preadjustment process (FIG. 4)) of causing the microphone 13*b* to acquire a sound emitted by the speaker 13*a* before the first operation, if the duration of the microphone output is shorter than the threshold TH2 related to time, the controller 11 configures the first settings to increase the time period during which the speaker 13*a* is driven in the first operation (in step S140). If the duration of the microphone output is equal to or longer than the threshold TH2, the controller 11 configures the second settings to increase at least any of the output from the speaker 13*a* and the degree of the amplification to be executed on the microphone output (in step S150).

According to the configuration, settings appropriate for the first operation (double feeding detection process) can be configured (or the sensor control settings can be optimized) based on the cause of a malfunction in the preadjustment process. Specifically, if the value output from the microphone 13*b* needs to be equal to or larger than the threshold TH1, but the value output from the microphone 13*b* is smaller than the threshold TH1 ("No" in step S110), the process is branched based on the comparison of the duration with the threshold TH2. It is, therefore, possible to differentiate between the case where a waveform received by the microphone 13*b* has a large amplitude but the duration of the received waveform is short and the case where the amplitude of a waveform received by the microphone 13*b* is small, and the sensor control settings are optimized based on the differentiation. Thus, for example, if the amplitude of a waveform received by the aforementioned microphone 13*b* is reduced to 0 at early time due to a distortion of the amplitude of the received waveform, the speaker driving time period is increased (in step S140), the value output from the microphone 13*b* is equal to or larger than the threshold TH1 (in step S140 to step S100 to step S110 to step S160) in a situation where the value output from the microphone 13*b* needs to be equal to or larger than the threshold TH1, and the accuracy of the double feeding detection to be executed after that can be improved.

In addition, according to the embodiment, the controller 11 executes the sweeping process of changing the frequency of a sound to be emitted by the speaker 13*a* to multiple frequencies and driving the speaker 13*a* in the second operation and the first operation. According to the sweeping process, even if the frequency (resonant frequency) to which the sensor 13 (ultrasonic sensor) is the most sensitive varies due to an effect of the temperature of the environment around the sensor 13, and the microphone output is not stable, an output value to be used to be compared with the threshold TH1 in the environment at that time can be accurately identified (in steps S100 and S200). Specifically, it is possible to remove the effect of the temperature and obtain microphone output appropriate for the preadjustment process and the double feeding detection process. In addition, in the configuration for executing the sweeping process, an adjustment mode for adjusting the driving frequency of the speaker 13*a* to any of frequencies to which a sensor is the most sensitive and a temperature sensor for detecting the temperature are not required.

Although the speaker driving time period is increased from the previous setting in step S140 (FIG. 4), the speaker 13*a* may be driven with a single driving frequency, and a wavenumber (wavenumber of a single continuous waveform) for the emission of a sound wave may be increased from the previously set wavenumber.

The second operation (preadjustment process) may not be executed before the shipment of the product (transporting apparatus 10). For example, the second operation and the first operation may be executed automatically or based on an operation by the user after the transporting apparatus 10 is shipped to market.

What is claimed is:

1. A transporting apparatus comprising:

a transportation mechanism that transports a medium;

a speaker and a microphone that are arranged opposite to each other with respect to a transportation path for the medium; and a controller that controls the transportation mechanism based on microphone output in a first operation of causing the microphone to acquire a sound emitted by the speaker and having passed through the medium being transported by the transportation mechanism, wherein if the microphone output does not satisfy a predetermined requirement and the duration of the microphone output is shorter than a threshold related to time in a second operation of causing the microphone to acquire a sound emitted by the speaker before the first operation, the controller configures first settings to increase a time period during which the speaker is driven in the first operation, and if the microphone output does not satisfy the predetermined requirement and the duration of the microphone output is equal to or longer than the threshold in the second operation, the controller configures second settings to increase at least any of output from the speaker and the degree of amplification to be executed on the microphone output in the first operation.

2. The transporting apparatus according to claim 1, wherein if there is a time period during which the microphone output is equal to or larger than a threshold related to the microphone output, and the duration of the microphone output that is equal to or longer than the threshold related to the microphone output is shorter than the threshold related to time in the second operation, the controller configures the first settings, and if there is not a time period during which the microphone output is equal to or larger than the threshold related to the microphone output, and the duration of the microphone output is equal to or longer than the threshold related to time, the controller configures the second settings.

3. The transporting apparatus according to claim 1, wherein if the maximum value of the microphone output obtained when the frequency of a sound to be emitted by the speaker is changed to multiple frequencies and the speaker is driven is equal to or larger than a threshold related to the maximum value, the controller configures third settings that do not correspond to the first settings and the second settings.

4. The transporting apparatus according to claim 1, wherein the controller executes the control based on an envelope waveform of the microphone output.

5. The transporting apparatus according to claim 1, wherein the controller changes the frequency of a sound to be emitted by the speaker to multiple frequencies and drives the speaker in the first operation.

6. The transporting apparatus according to claim 5, wherein the controller controls the frequency so that a range in which the frequency is changed in the first operation executed at predetermined time after the initial first operation executed after the second operation is narrower than a range in which the frequency is changed in the initial first operation executed after the second operation.

* * * * *